US005088142A

United States Patent [19]

Muller

[11] Patent Number: 5,088,142

[45] Date of Patent: Feb. 18, 1992

[54] DEVICE FOR SECURING A CABLE TO THE CONCRETE PLATFORM OF A BRIDGE, AND BRIDGE EQUIPPED WITH SUCH DEVICES

[75] Inventor: Jean Muller, Suresnes, France

[73] Assignee: Societe Anonyme Dite Societe Centrale d'Etudes et de Realisations Routieres, Paris, France

[21] Appl. No.: 425,201

[22] PCT Filed: Feb. 3, 1989

[86] PCT No.: PCT/FR89/00041

§ 371 Date: Dec. 10, 1990

§ 102(e) Date: Dec. 10, 1990

[87] PCT Pub. No.: WO89/07174

PCT Pub. Date: Aug. 10, 1989

[30] Foreign Application Priority Data

Feb. 5, 1988 [FR] France ..... 88 01343

[51] Int. Cl.[5] ..... E01D 19/00; E01D 11/00

[52] U.S. Cl. ..... 14/22; 14/18

[58] Field of Search ..... 14/18, 21, 22

[56] References Cited

U.S. PATENT DOCUMENTS

| | | | |
|---|---|---|---|
| 3,414,924 | 12/1968 | Perkey | 14/22 |
| 3,491,393 | 1/1970 | Neeld et al. | 14/22 |
| 3,953,980 | 5/1976 | Bennet | 14/18 X |
| 4,648,147 | 3/1987 | Zimmerman et al. | 14/22 X |
| 4,987,629 | 1/1991 | Muller | 14/22 |

FOREIGN PATENT DOCUMENTS

| | | | |
|---|---|---|---|
| 3434620 | 4/1986 | Fed. Rep. of Germany | 14/22 |
| 2592666 | 7/1987 | France | 14/22 |
| 8807604 | 10/1988 | France . | |

*Primary Examiner*—Ramon S. Britts
*Assistant Examiner*—Nancy Connolly
*Attorney, Agent, or Firm*—Breiner & Breiner

[57] ABSTRACT

This invention relates to a device for fastening a guy to a concrete bridge deck. A metal plate is abutted against the horizontal surface of the deck and retained there with pre-stressing cables at its top surface and an extension which protrudes downward into the deck from its bottom surface. An anchoring device is mounted on the upper surface of the plate. It may be positioned to keep the guy in a plane parallel to the plate and do not require that the cables pass through the deck. The deck may have spaced bearing surfaces that are angled and/or are parallel to one another and support anchoring devices that keep the cables running in different directions from one another.

8 Claims, 4 Drawing Sheets

DEVICE FOR SECURING A CABLE TO THE CONCRETE PLATFORM OF A BRIDGE, AND BRIDGE EQUIPPED WITH SUCH DEVICES

The present invention relates to a device for fastening a guy to a concrete deck of a bridge, especially of a bridge with so-called "radiating" guying, in which a series of guys connects uniformly spaced points of the deck to the top of a supporting mast.

According to the conventional techique, a guy is fastened to the deck by ensuring that the guy passes through the deck, usually in the region of a longitudinal boom, in order to carry, on the opposite face of the deck, end retention means which bear on this lower face of the deck.

When the deck is made of reinforced concrete, the presence of the tubes containing the guys, which are at inclinations varying uniformly from one end of the bridge to the other, the angle with the horizontal decreasing in proportion to the distance from the mast, disturbs the reinforcing device to a considerable extent, thus making it necessary to produce the latter with particular care which is incompatible with high-speed production or with prefabrication on a relatively industrial scale.

The object of the invention is to overcome this disadvantage and to provide a fastening device which does not make it necessary to change the reinfoarcing planes in the region of each fastening of the guy and which consequently makes it possible to achieve faster construction less liable to risks of error.

To achieve this result, the invention provides a device for fastening a guy to a concrete deck of a bridge which comprises:

a metal plate, one face of which is designed to come up against a plane bearing surface of the deck, this face carrying at least one projection capable of penetrating into a cavity of the deck, to prevent the plate and the said plane bearing surface from sliding one relative to the other, means for fastening the end of the guy, these means being carried by mountings fixed to the face of the plate opposite that designed to come to bear against the deck, and prestressing cables or ties capable of keeping the plate bearing against the plane surface of the deck, these cables or ties bearing on the side of the deck opposite that carrying the said plane surface.

Preferably, the projection and/or the cavity have a form of revolution about an axis perpendicular to the plane of the plate of the plane bearing surface, to allow the device to be oriented according to the direction of the guy.

In an advantageous embodiment, the projection contains retention means for one of the said prestressing cables or ties.

According to a first embodiment, the fastening means are intended to make it possible to maintain the guy at a non-zero inclination relative to the plate. This arrangement is used advantageously ii the said plane bearing surface of the deck is a horizontal surface and if the prestressing cables or ties pass downwards through the deck so as to come to bear on a horizontal surface extending in the opposite direction of the said deck.

According to another embodiment, the anchoring means are intended to make it possible to keep the guy in a plane parallel to that of the plate. This second embodiment is especially advantageous if the plane bearing surface of the deck is carried by one of the edges of the deck and has, relative to the vertcal, the same angle as the sheet of which the guy which the device is to hold forms part, and if the prestressing cable or tie passes through the deck in a direction which as a whole is transverse and approximately horizonta..

The invention also provides a guyed bridge which is equipped with devices such as those described above, and the particular feature of which is that the deck carries, at regular intervals, plane bearing surfaces oriented parallel to one another, and the plane bearing surfaces support fastening devices which maintain the cables at different directions from one another.

The invention will now be explained in more detail with reference to practical examples illustrated by means of the drawings of which:

Figure 8:
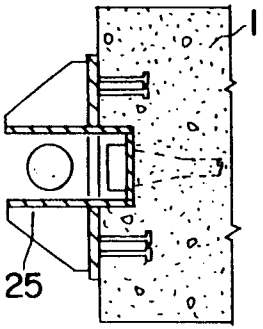
Figure 5:
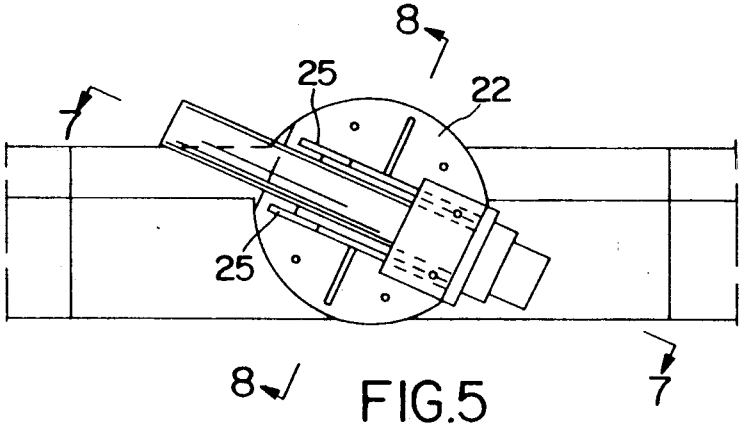
FIG. 5 is a view of a second embodiment of the fastening device according to the invention in a transverse direction.
Figure 7:
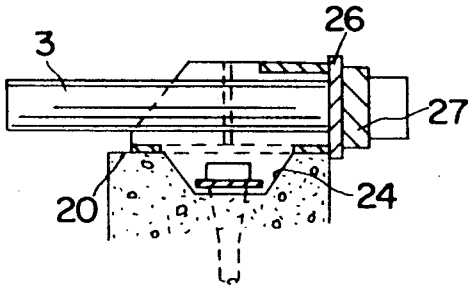
FIG. 7 is a longitudinal section of the device in an inclined plane containing the guy.

FIG. 8. is a section through the device perpendicular to the direction of the guy.

Figure 1:
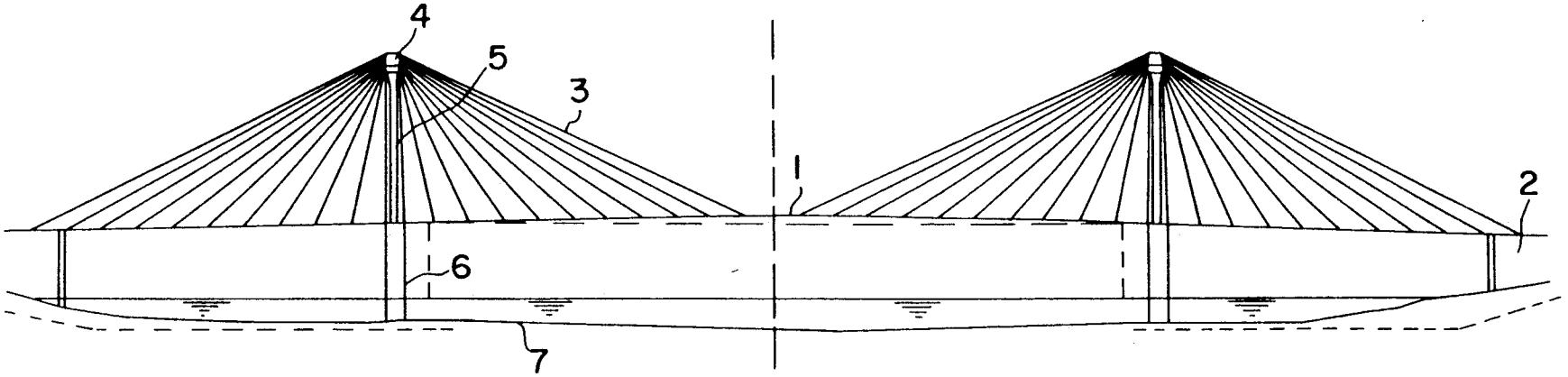
FIG. 1 is an elevation view of a guyed bridge for which the device according to the present invention is suitable.

FIG. 1 illustrates a bridge, the deck 1 of which rests on abutments 2 at one end and is supported by guys 3 which connect successive points of the deck to the top 4 of a mast 5 mounted on piers 6 resting on the ground 7.

Figure 2:
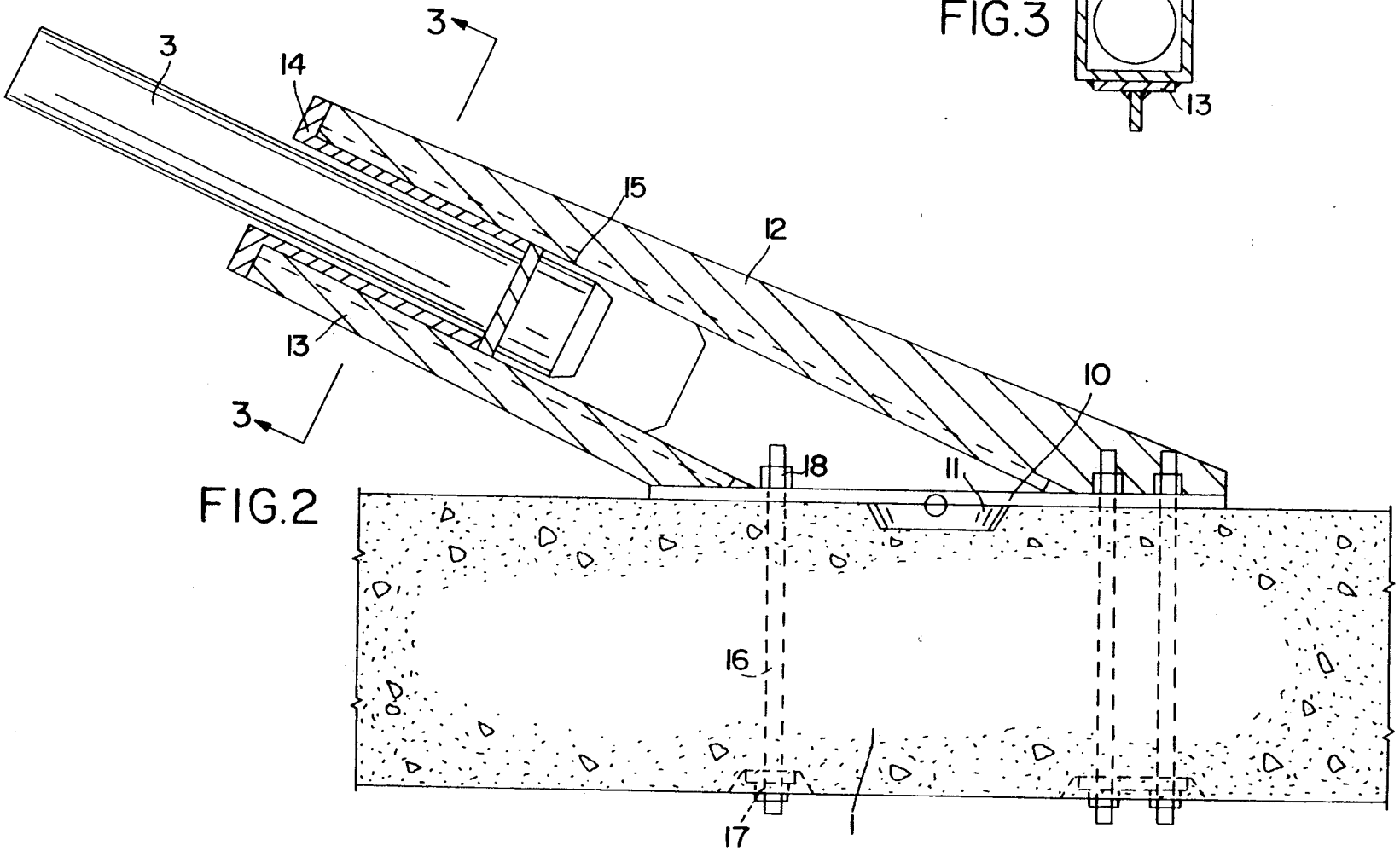
FIG. 2 is a longitudinal section through a first embodiment of a device according to the invention.

FIG. 2 shows a fastening device according to the invention mounted on the horizontal upper face of a deck 1.

The device comprises a plate 10 carrying, in its lower part, a frustoconical projection 11 which penetrates into a corresponding cavity of the upper face of the deck 1. On the upper face of the plate 10, T-section bars 12, 13 are secured obliquely to the said plate 11, their general direction forming with the torizontal an angle equal to that of the guy 3 which the device is intended for retaining. The end of the gcy 3 passes through a fastening piece 14 welded to the bars 12 and 13 and bears on this piece 14 by means of an endpiece 15. Prestressing ties 16 pass through the entire thickness of the deck 11 and, by means of screws 17, 18, clamp the plate 10 firmly against the deck. The tensile forces exerted by the tie 3 can be broken down into a vertical component absorbed by the ties 16 and a horizontal component which is transmitted to the deck by the projection 11 and as a result of the friction of the plate 10 against the horizontal bearing surface prcvided on the deck.

FIGS. 5 to 8 show another embodiment. The deck, on its outer edge or margin, has a bearing surface 20 directed longitudinally and slightly obliquely relative to the vertical. The bearing surface 20 as a whole is circular. The deck 1, since it is relatively thin, has an extra thickness 21 for receiving this bearing surface. The actual fastening device comprises a c rcular plate 22 which comes to bear on the surface 20 and which, in its part facing the deck, carries a frustoconical projection 23 which is hollow and which comes to rest in a likewise frustoconical cavity 24 provided at the centre of the bearing surface 20. The plate 22, on its face opposite the projection 23, carries mountings consisting of two identical flat bars 25 arranged perpendicularly relative to the plate 20 and between them forming a kind of fork, between which is accommodated a supporting piece 26, against which bears an end piece 27 fixed to the guy 3. The hollow projection 23 serves as a receptacle for the anchoring head of a prestressing cable 28 which penetrates into the deck 1 via an oblique passage perpendicular to the plane of the surface 20. This cable subsequently curves to become horizontal and passes through the entire width of the deck, in order to be anchored to a similar device located on the opposite nargin of the deck.

It will be appreciated that, to install the guys, the device must be oriented by pivoting the plate about the axis of the cavity 24, until it is brought into the right direction. The inclination of the surfaces 20 relative to the horizontal is that of all the guys of the same sheet of cables supporting the edge of the deck. It is therefore sufficient, during the construction of the bridge, to provide bearing surfaces 20 identical to one another at the intended locations on the deck and each time orient the plate 22 to obtain a perfect alignment of the fastening device with the cables.

Figure 3:
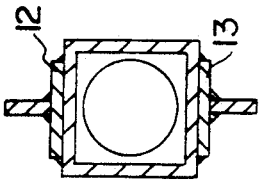
FIG. 3 is a section through the device of FIG. 2 in a plane perpendicular to the guy.
Figure 4:
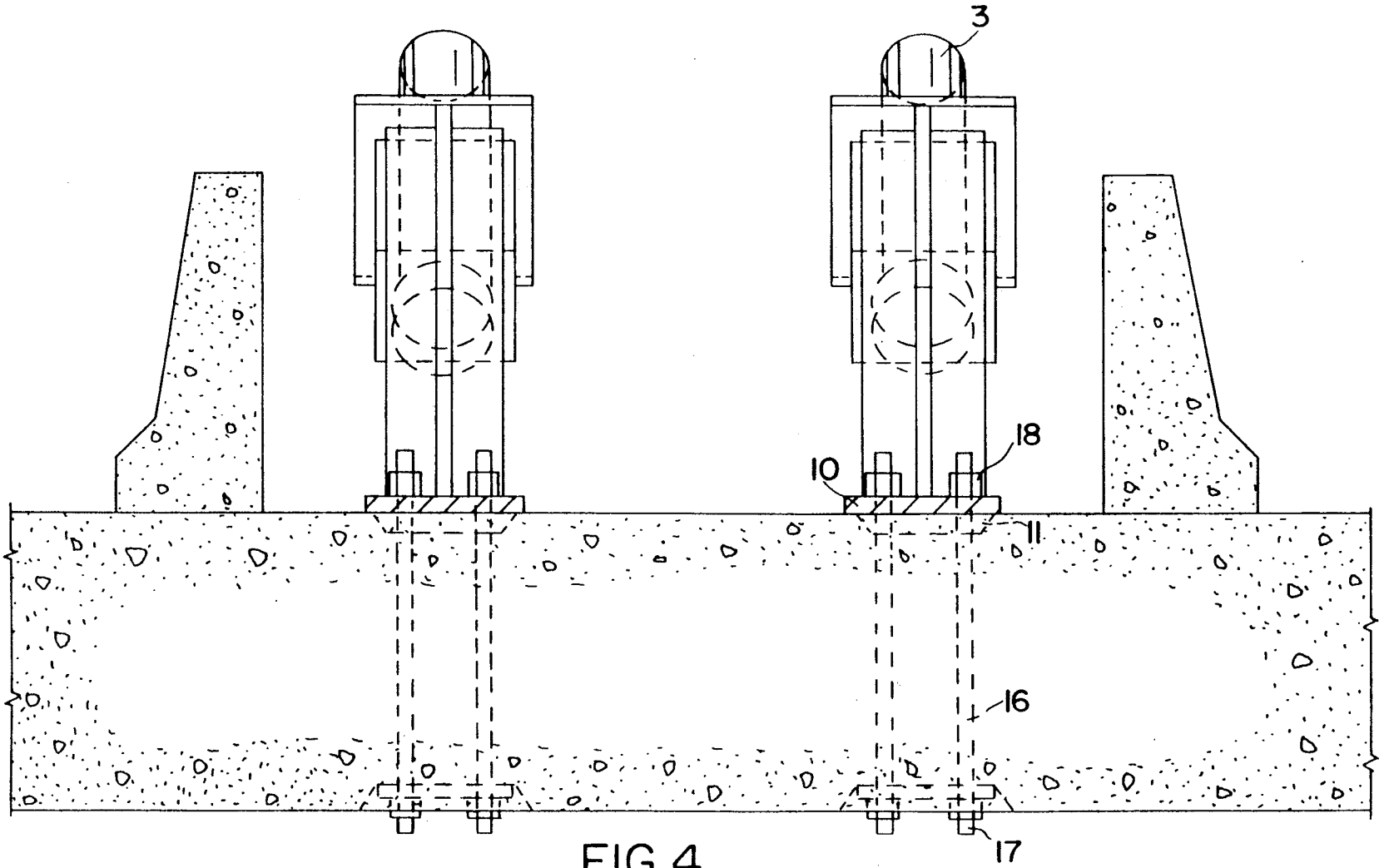
FIG. 4 is a view of the device of FIG. 2 in a longitudinal direction.
Figure 6:
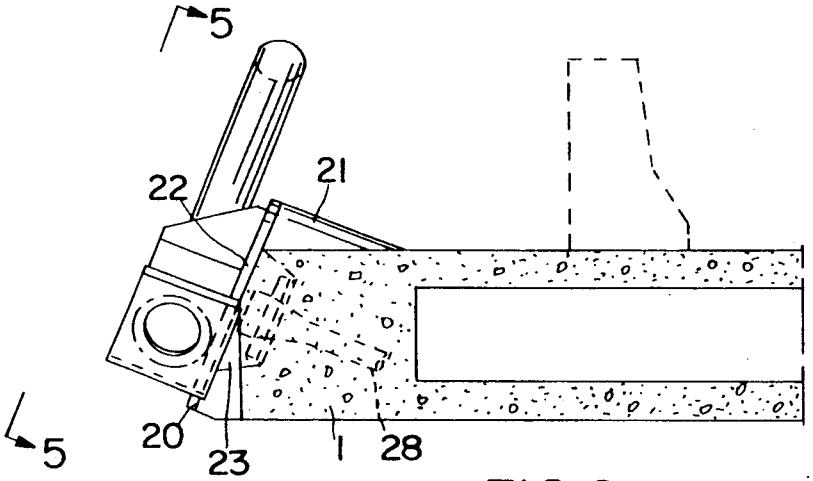
FIG. 6 is a partial cross-section through a deck possessing the device of FIG. 5.

With the arrangement of FIGS. 2 to 4, it is necessary to ensure that the orientation of the mountings 12 and 13 is changed for each fastening point. This complication is compensated because there is no need to have a prestressing cable passing through the entire deck. It is possible, moreover, to provide an articulated connection between the mountings 12 and 13 and the fastening piece 14, thus making it possible to use the same piece for a certain number of guys at this particular moment, at least within certain limits.

I claim:

1. Device for fastening a guy to a concrete deck of a tridge, characterized in that it comprises:

a metal plate, one face of which is designed to come to bear against a plane bearing surface of the deck, this face carrying at least one projection capable of penetrating into a cavity of the deck, to prevent the plate and the said plane bearing surface from sliding one relative to the other, means for fastening the end of the guy, these means being carried by mountings fixed to the face of the plate opposite that designed to come to bear against the deck, and prestressing cables or ties capable of keeping the plate bearing against the plane surface of the deck, these cables or ties bearing on the side of the deck opposite that carrying the said plane surface.

2. Device according to claim 1, characterized in that the projection and/or the cavity have a form of revolution about an axis perpendicular to the plane of the plate or of the plane bearing surface, to allow the device to be oriented according to the direction of the guy.

3. Device according to claim 1, characterized in that the projection contains the retention means for a prestressing cable or tie.

4. Device according to claim 1, characterized in that the fastening means are intended to make it possible to maintain the guy at a non-zero inclination relative to the plate.

5. Device according to claim 4, characterized in that the said plane bearing surface of the deck is a horizontal surface, and the prestressing cables or tes pass downwards through the deck, so as to bear on a horizontal surface extending in the opposite direction of the said deck.

6. Device according to claim 1, characterized in that the fastening means are intended to make it possible to keep the guy in a plane parallel to that of the plate.

7. Device according to claim 6, characterized in that the plane bearing surface of the deck is carried by one of the edges of the deck and has, relative to the vertical, the same angle as the sheet of which the gJy which the device is to hold forms part, and the pre-stressing cable or tie passes through the deck in a direction which as a whole is transverse and approximately horizontal.

8. Guyed bridge equipped with devices according to claim 1, characterized in that the deck carries, at regular intervals, plane bearing surfaces oriented parallel to one another, these plane bearing surfaces supporting the anchoring devices which maintain the cables at different directions from one another.

* * * * *